US006789064B2

(12) United States Patent
Koh

(10) Patent No.: US 6,789,064 B2
(45) Date of Patent: Sep. 7, 2004

(54) MESSAGE MANAGEMENT SYSTEM

(75) Inventor: Jocelyn K. Koh, Friendswood, TX (US)

(73) Assignee: International Business Machines Corporation, Armonk, NY (US)

( * ) Notice: Subject to any disclaimer, the term of this patent is extended or adjusted under 35 U.S.C. 154(b) by 528 days.

(21) Appl. No.: 09/734,507

(22) Filed: Dec. 11, 2000

(65) Prior Publication Data

US 2002/0072906 A1 Jun. 13, 2002

(51) Int. Cl.[7] ..... G10L 13/08
(52) U.S. Cl. ..... 704/260; 455/412
(58) Field of Search ..... 704/200, 235, 704/258, 260; 379/88.03, 88.19, 88.25, 88.17; 455/412, 413

(56) References Cited

U.S. PATENT DOCUMENTS 4,881,260 A * 11/1989 Wen ..... 379/76
4,972,462 A 11/1990 Shibata
4,985,913 A * 1/1991 Shalom et al. ..... 379/76
5,434,908 A * 7/1995 Klein ..... 379/88.23
5,479,411 A 12/1995 Klein
5,479,491 A * 12/1995 Herrero Garcia et al. ..... 379/88.15
5,497,373 A 3/1996 Hulen et al.
5,557,659 A 9/1996 Hyde-Thomson
5,768,347 A * 6/1998 Beyda ..... 379/67.1
5,768,349 A * 6/1998 Knuth et al. ..... 379/88.22
5,924,068 A 7/1999 Richard et al.
5,940,797 A 8/1999 Abe
5,950,167 A 9/1999 Yaker
5,953,392 A 9/1999 Rhie et al.
6,181,781 B1 * 1/2001 Porter et al. ..... 379/88.17
6,266,399 B1 * 7/2001 Weller et al. ..... 379/88.19
6,266,400 B1 * 7/2001 Castagna ..... 379/88.25
6,324,272 B1 * 11/2001 Abu-Shukhaidem et al. .... 379/142.06

* cited by examiner

*Primary Examiner*—Daniel Abebe
(74) *Attorney, Agent, or Firm*—Norman L. Gundel; Hoffman, Warnick & D'Alessandro LLC

(57) ABSTRACT

A system and method for managing voice messages by (1) combining prerecorded phrases with message templates to generate messages, and (2) providing a scheduling interface for scheduling generated messages. The invention comprises: a phrase management module for managing recorded phrases; a template management module for managing message templates; a message generation module for creating a message by inserting at least one recorded phrase into a selected message template; and a scheduling system for scheduling the message.

21 Claims, 6 Drawing Sheets

MESSAGE MANAGEMENT SYSTEM

BACKGROUND OF THE INVENTION

1. Field of the Invention

The present invention relates generally to message management systems, and more particularly to a system and method for creating and managing voice mail message greetings.

2. Related Art

In today's business environment, people often must perform multiple tasks simultaneously. This often requires that individuals be on or away from their phones when a caller attempts to reach an individual. Because the caller may want to leave more information than just a name and return phone number where the caller can be reached, voice mail is regularly used by many of today's businesses. Voice mail allows an individual to record a personalized greeting and retrieve voice messages from the individual's phone, in the individual's voice mail-box. Thus, voice mail eliminates or reduces the need for a receptionist to field calls and manually write down messages. Another advantage voice mail provides is that individuals can screen their calls so that they are not bothered by unwanted phone solicitations and the like.

As voice mail systems have become more sophisticated and commonplace, a large number of organizations now rely heavily or exclusively on their voice mail systems to direct and record messages from callers. Accordingly, a business's voice mail system is often the primary interface for the outside world, as well as for the rest of the company. As organizations place greater emphasis on customer service, the need to provide accurate and appropriate greetings are becoming more and more important. Unfortunately, although most voice mail systems allow users to record and edit their greetings, as well as record alternate greetings from their phone, most users do not bother changing their greetings once they are recorded. Thus, greetings often fail to precisely state the availability of the person trying to be reached. For example, most users do not bother editing their voice mail greeting for different scenarios, such as when they are in a meeting, on vacation, sick, on the road, available at another extension, etc.

The reason why most individuals do not regularly alter their greetings is because the user interfaces provided by most voice mail systems have limited functionality and are time consuming to use. To change a greeting, a user typically must go through a menu of choices, record their greeting, listen to their greeting, re-record the greeting if it is incorrect, and then later remember to change it back to the original greeting if necessary. Since most voice mail systems allow only two greetings, standard and alternate, it is not possible to store numerous greetings for all the different scenarios when a different greeting would be appropriate. To go through the above-mentioned steps for each different scenario is simply not worth the effort given the present state of the art. Moreover, voice mail systems do not allow a user to schedule greetings for the future. Thus, a user must remember to change his or her greeting immediately before and after each new scenario.

Given the current state of the art and the often hectic work pace common in today's business environment, most individuals are simply unable to effectively manage their greetings. Accordingly, a need exists for a phone mail system that will allow users to easily alter and schedule their greetings.

SUMMARY OF THE INVENTION

The present invention provides a system and method for managing voice messages by (1) combining phrases with message templates to generate messages, and (2) providing a scheduling interface for scheduling generated messages. In a first aspect, the invention provides a system for managing voice messages, comprising: a phrase management module for managing phrases; a template management module for managing message templates; a message generation module for creating a message by inserting at least one phrase into a selected message template; and a scheduling system for scheduling the message.

In a second aspect, the invention provides a program product stored on a recordable media for managing voice messages, which when executed, comprises: a system for inputting a message template from a plurality of message templates; a system for selecting a phrase; and a system for creating a message by inserting the phrase into the selected message template.

In a third aspect, the invention provides a method for managing voice messages, comprising the steps of: selecting a message template; selecting a phrase; and combining the phrase with the message template to form a message.

It is therefore an advantage of the present invention to provide a system and method for creating messages based on templates and phrases.

It is therefore a further advantage of the present invention to provide system and method for scheduling greetings.

BRIEF DESCRIPTION OF THE DRAWINGS

The preferred exemplary embodiment of the present invention will hereinafter be described in conjunction with the appended drawings, where like designations denote like elements, and.

DETAILED DESCRIPTION OF THE DRAWINGS

Figure 1:
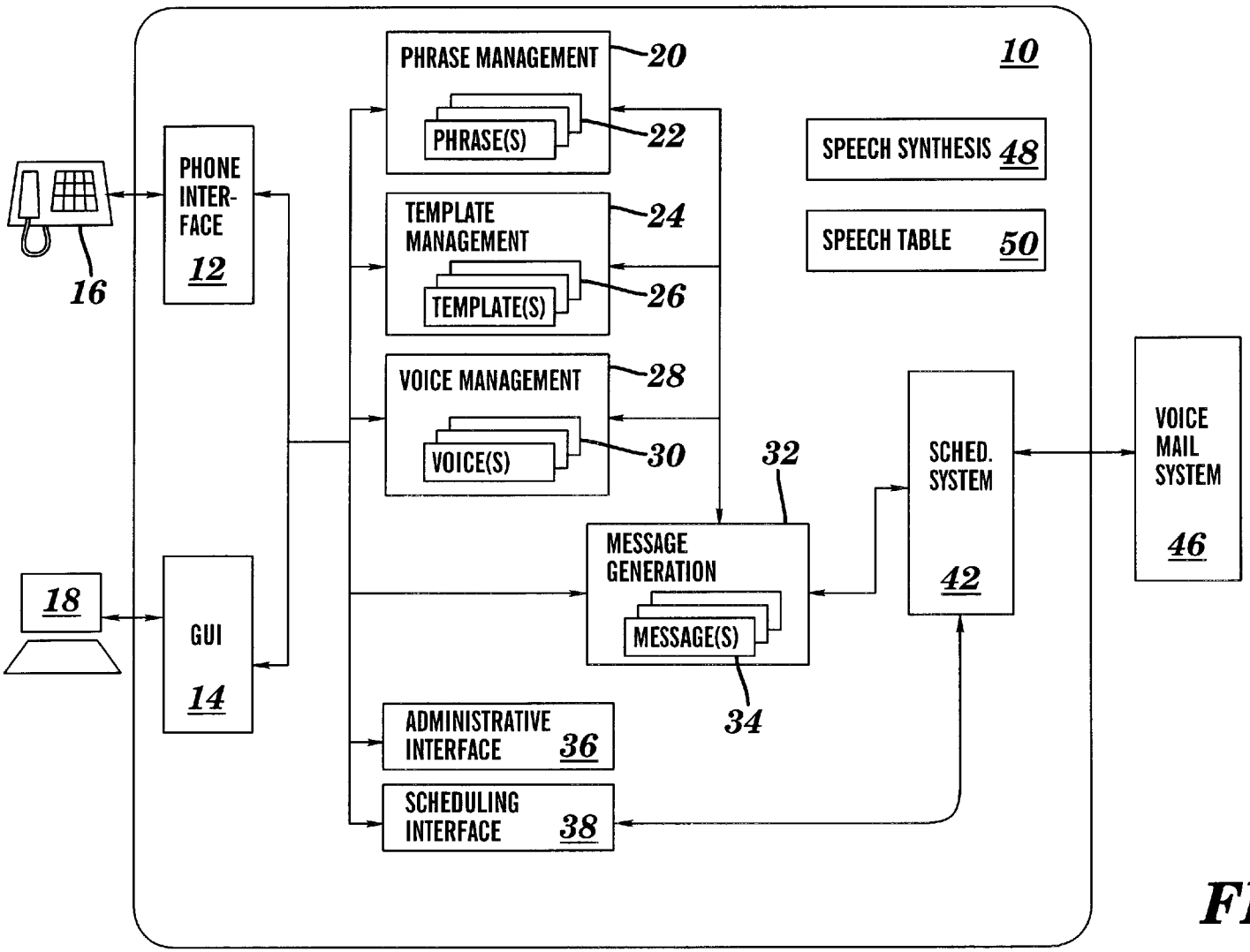
FIG. 1 depicts a message management system in accordance with a preferred embodiment of the present invention.

Referring now to FIG. 1, a voice message management system 10 is depicted. Voice message management system 10 interfaces with voice mail system 46, and allows users to manage and create messages or greetings that will be played when a caller is routed to a user's voice mail box. Voice mail system 46 may comprise any system known in the art. Moreover, for the purposes of this disclosure, the terms "message" and "greeting" are used interchangeably to refer to any recorded or generated audio communication, and "users" are individuals or entities that have an assigned voice mailbox. Users may interface with system via a standard telephone 16/phone interface 12, or via a computer terminal 18/graphical user interface (GUI) 14. Through interfaces 12 and 14, users can: (1) generate any number of greetings, (2) schedule dates and times for when particular greetings should be played, and (3) administer their voice mailbox accounts.

It should be understood that voice message management system 10 may exist as standalone software program product, as a computer system having a memory and processor for storing and executing the described features, or as part of a server in a network environment (e.g., the world wide web). In addition, it is understood that the present invention can be realized in hardware, software, or a combination of hardware and software. The components as described herein can be realized in a centralized fashion in a single computerized workstation, or in a distributed fashion where different elements are spread across several interconnected computer systems (e.g., a network). Any kind of computer system—or other apparatus adapted for carrying out the methods described herein—is suited. A typical combination of hardware and software could be a general purpose computer system with a computer program that, when loaded and executed, controls system 10 such that it carries out the methods described herein. Alternatively, a specific use computer, containing specialized hardware for carrying out one or more of the functional tasks of the invention could be utilized. The present invention can also be embedded in a computer program product, which comprises all the features enabling the implementation of the methods described herein, and which—when loaded in a computer system—is able to carry out these methods. Computer program, software program, program, module, mechanism or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

Figure 5:
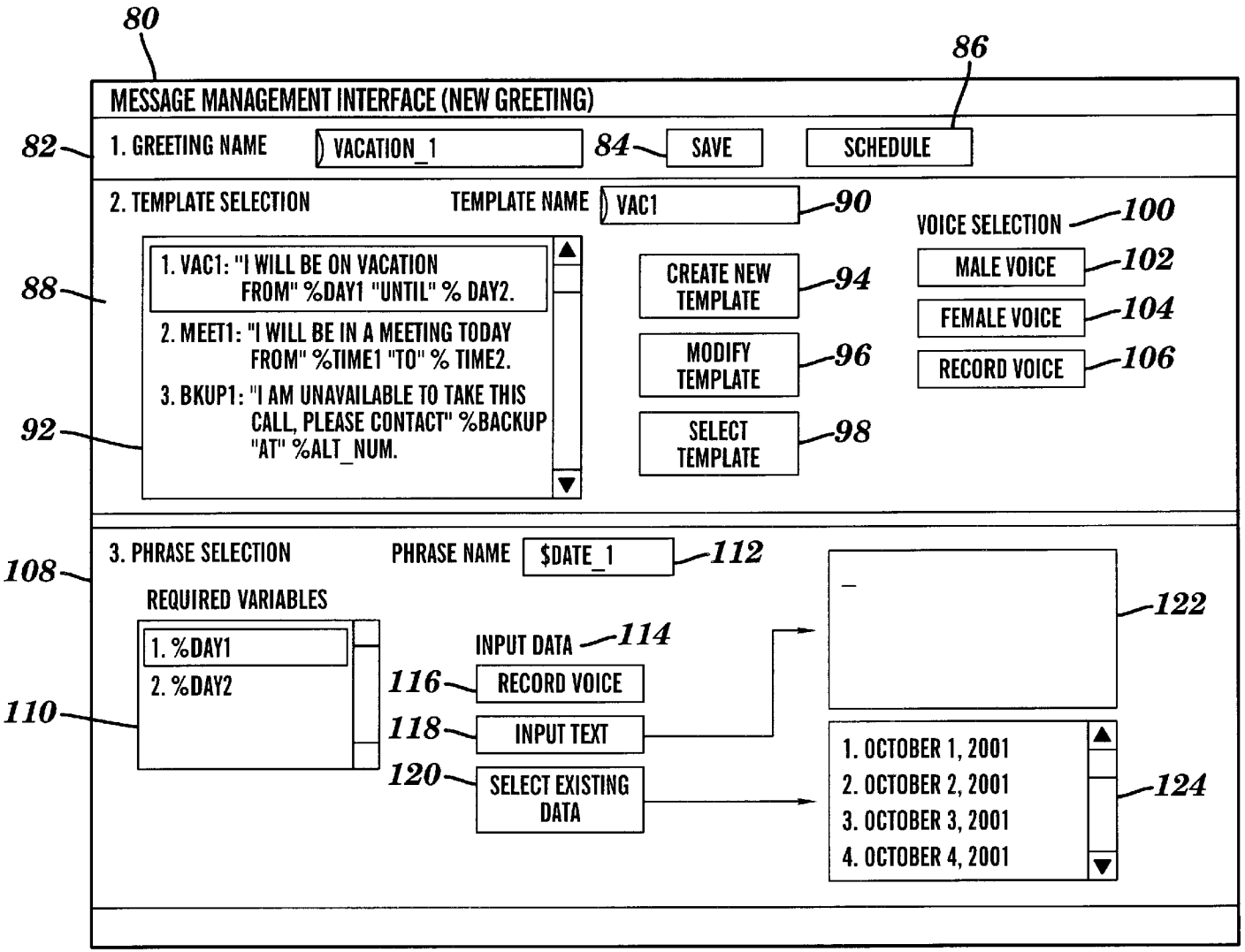
FIG. 5 depicts a message management interface.

Central to system 10 is message generation module 32, which is where messages 34 are generated. An exemplary graphical user interface for message generation module 32 is depicted in FIG. 5, and is described in further detail below. Message generation module 32 allows a user to select or create a generic message template (e.g., a vacation greeting); customize it with specific phrases (e.g., dates); and select a type of articulation (e.g., a male voice). Accordingly, each generated message 34 comprises three fundamental elements: a message template 26; one or more phrases 22; and a voice type 30. Because the number and variety of templates 26, phrases 22, and voices 30 can be virtually unlimited, each message element may be managed separately by a template management module 24, a phrase management module 20, and a voice management module 28, respectively. In general, these management modules 20, 24 and 28 allow users to input, create, and modify each of the respective message elements. These elements are brought together by message generation module 32 to form actual messages. The operation of these modules is described in further detail below.

Figure 6:
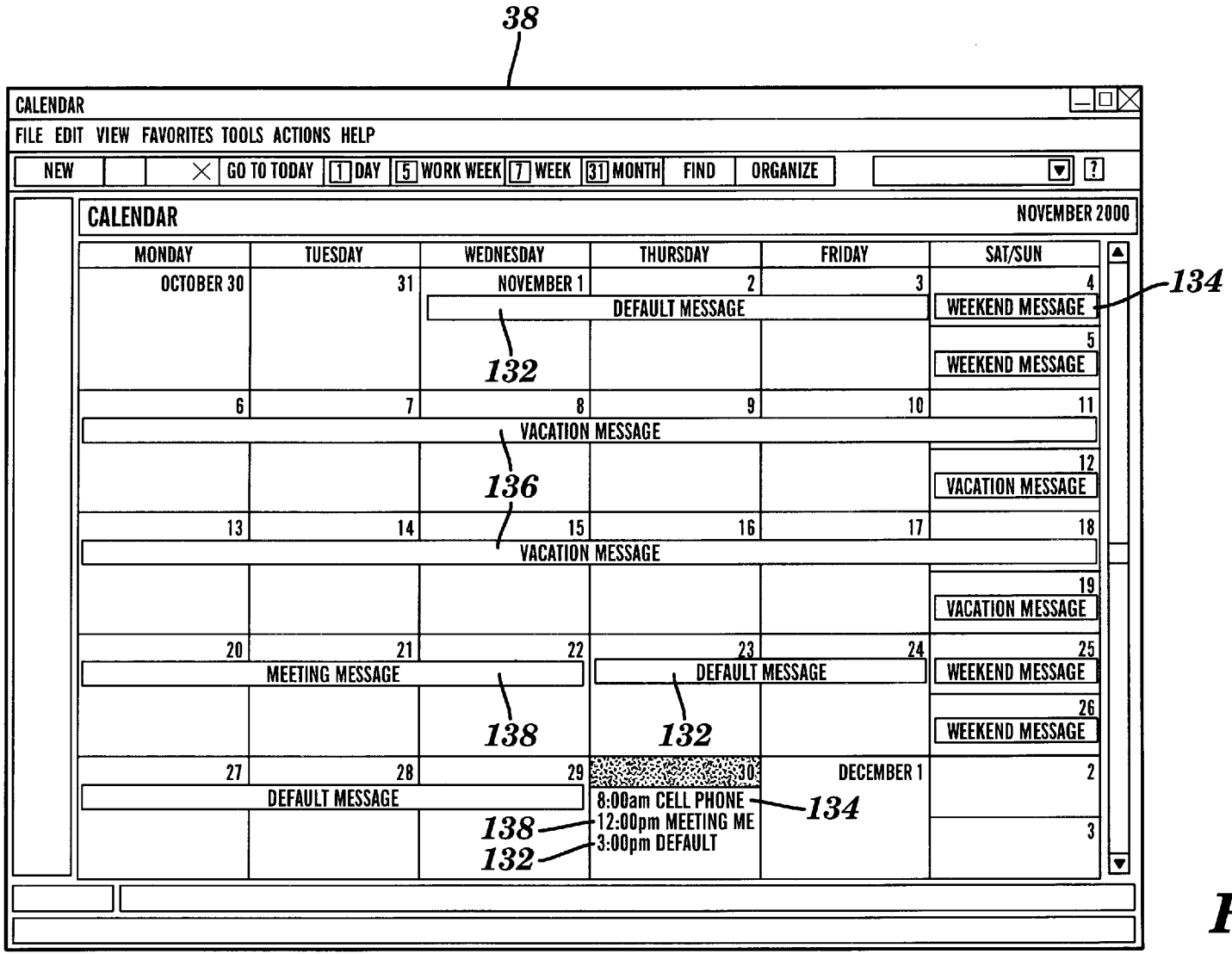
FIG. 6 depicts a scheduling interface.

System 10 also provides a scheduling interface 38 and scheduling system 42, which allows users to schedule dates and times in which messages 34 are to be played within a user's voice mailbox by voice mail system 46. An exemplary scheduling interface 38 is shown in FIG. 6 and described in further detail below. By including a scheduling system 42, users need not worry about constantly changing or monitoring their greetings. Instead, messages 34 will be automatically updated based on what the user scheduled in the scheduling interface 38. Accordingly, users can schedule messages that will accurately reflect given scenarios (e.g., a planned vacation) weeks, months, or years in advance. Moreover, messages can be scheduled to have any duration, e.g., an hour long meeting, a two-week vacation, a one year sabbatical, etc.

System 10 further includes an administrative interface 36, which allows a user to, among other things, set preferences, establish passwords, etc. Also, included in system 10 are speech synthesis module 48 and speech table 50. Speech synthesis module 48 is used to convert text to a voice file or audio output. Speech synthesis module 48 may comprise any known system or method for converting text information to audio. As an alternative, a speech table 50 may be utilized. Speech table 50 would associate a text string with a prerecorded voice file. Accordingly, if a user selected a particular text string on graphical user interface 14, the speech table could associate it with a prerecorded voice file stored within the system 10.

Figure 2:
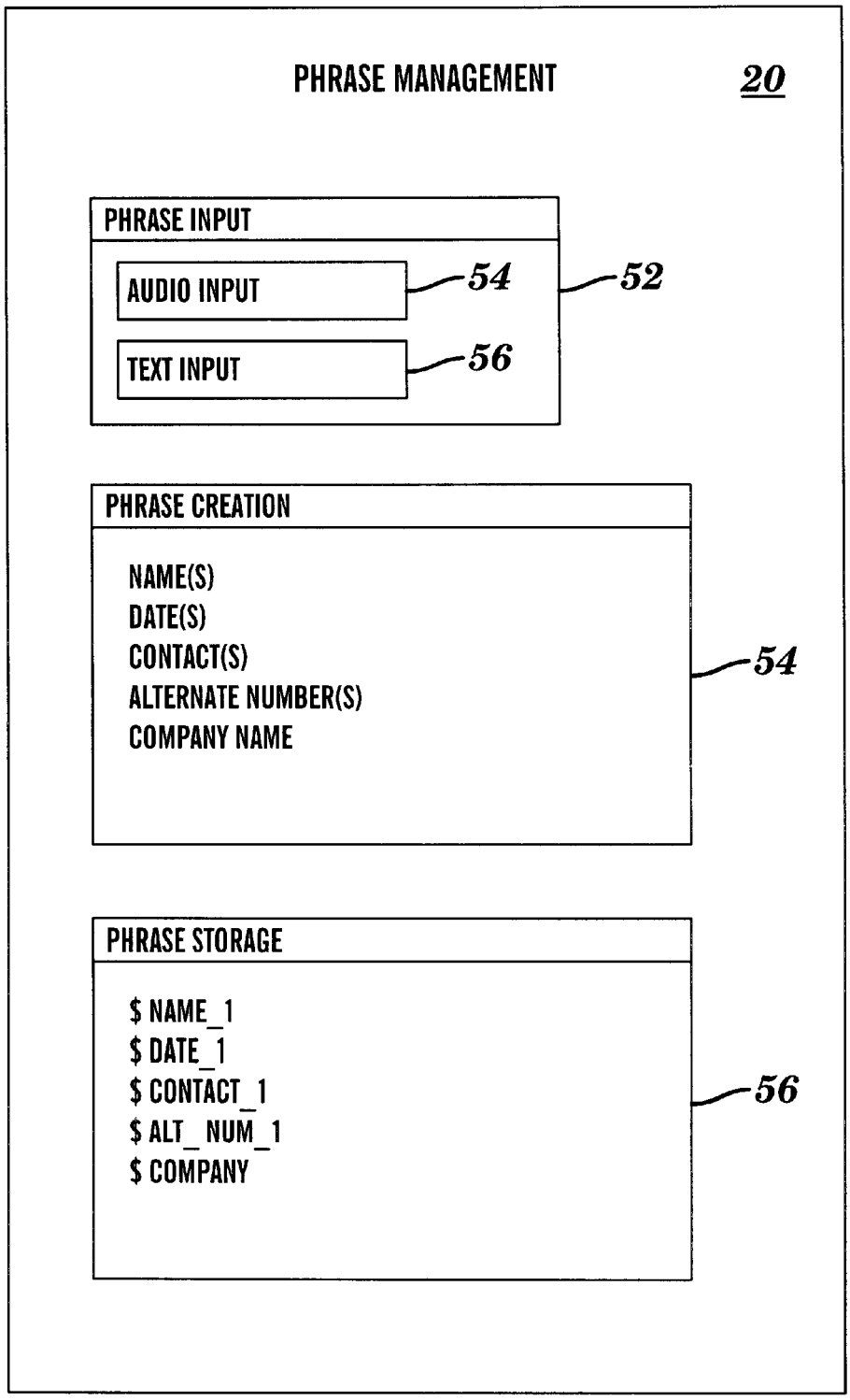
FIG. 2 depicts a phrase management module of FIG. 1 in further detail.

Referring now to FIG. 2, the phrase management module 20 of FIG. 1 is shown in greater detail. A phrase, as used herein, generally comprises specific details of a message or greeting that will be plugged into a message template. While there are no limitations on what constitutes a phrase, typical phrases are characterized as details or data that may regularly change, or that may otherwise lend itself to being separately stored. Examples of phrases may include a user's name, dates, contacts, alternate numbers, company name, etc. By storing phrase details separately, the remaining content of a typical greeting can be reused. Thus, each time an employee of an organization went on vacation, a standard vacation greeting could be used, with only trivial alteration to specific phrases, e.g., dates and back-up numbers. Each phrase is implemented as a phrase name or identifier (e.g., $date1) and phrase data (e.g., "Oct. 10, 2001"). Phrases may be stored as text, as a digital audio file, or in any other format, e.g., $date1="Oct. 10, 2001." Storage and retrieval of phrases are handled by phrase storage system 56.

In the event a user needs to create a new phrase, for example, a personal cell phone number, it would be accomplished with phrase creation system 54. New phrases could be selected from either an existing database of phrases, or inputted with phrase input system 52. Phrase input system 52 allows phrase data to be inputted either as audio input 54 or as text input 56. Audio input could be accomplished over phone 16, or via a microphone attached to computer terminal 18. Text input 56 could be entered via computer terminal 18, on the keypads of phone 16, on a personal digital assistant (PDA), etc. A feature that would allow a user the ability to separately "copy," "save-as," and/or "rename" text input 56, may also be included.

Figure 3:
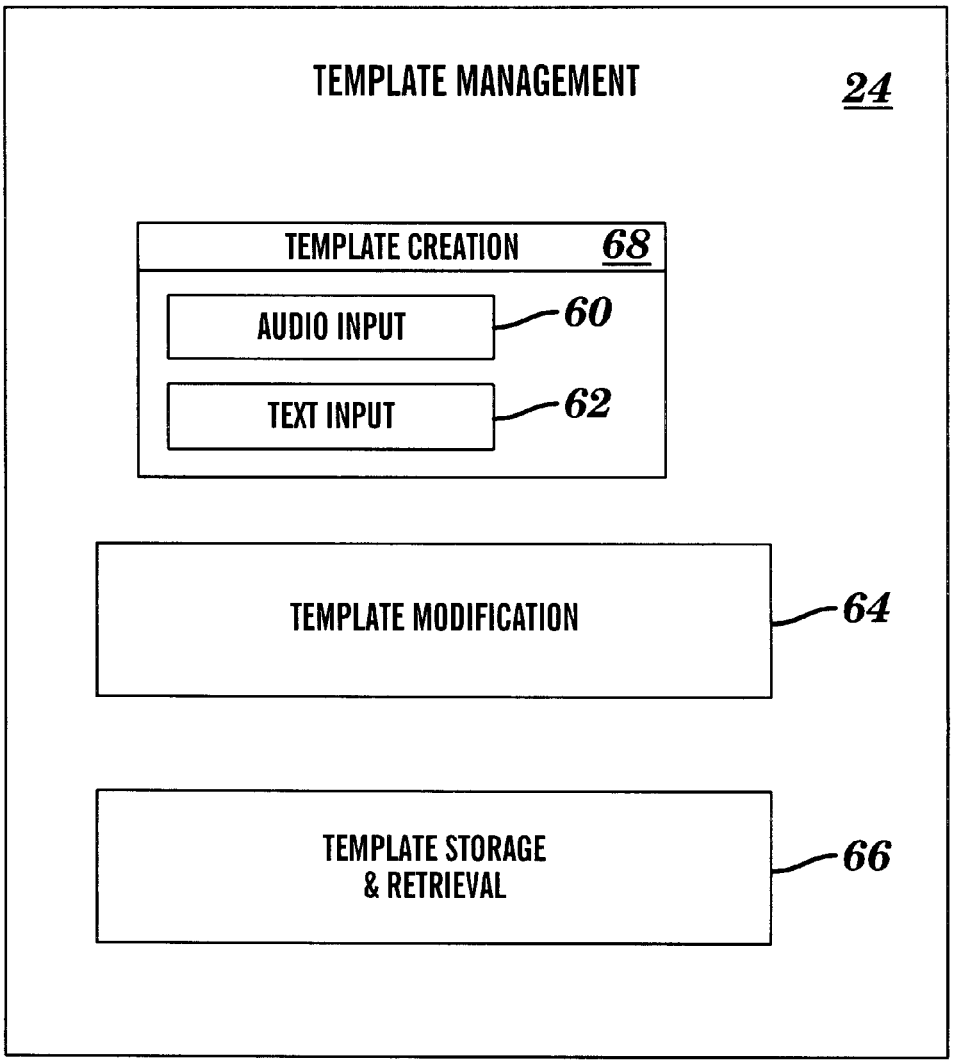
FIG. 3 depicts a template management module of FIG. 1 in further detail.

Referring now to FIG. 3, template management module 24 is depicted in further detail. Templates 26 generally comprise a string of recorded words (audio or text) in which one or more specific details are left undefined. Such undefined details exist within the string in the form of a variable. Templates may also be given a name or identifier. Accordingly, an exemplary template entitled "OUT_UNTIL" may comprise the string: "I will be out of the office until % day," where % day is the undefined variable. Template management module 24 manages the creation, modification and storage of such templates. Creating new templates is handled by template creation system 58. Templates can be created using an audio input 60 or text input 62 in the same manner as phrase input system 52 described above. Template management module 24 also includes a template modification system 64 for modifying existing templates and a template storage and retrieval system 66 for storing and retrieving created templates.

Figure 4:
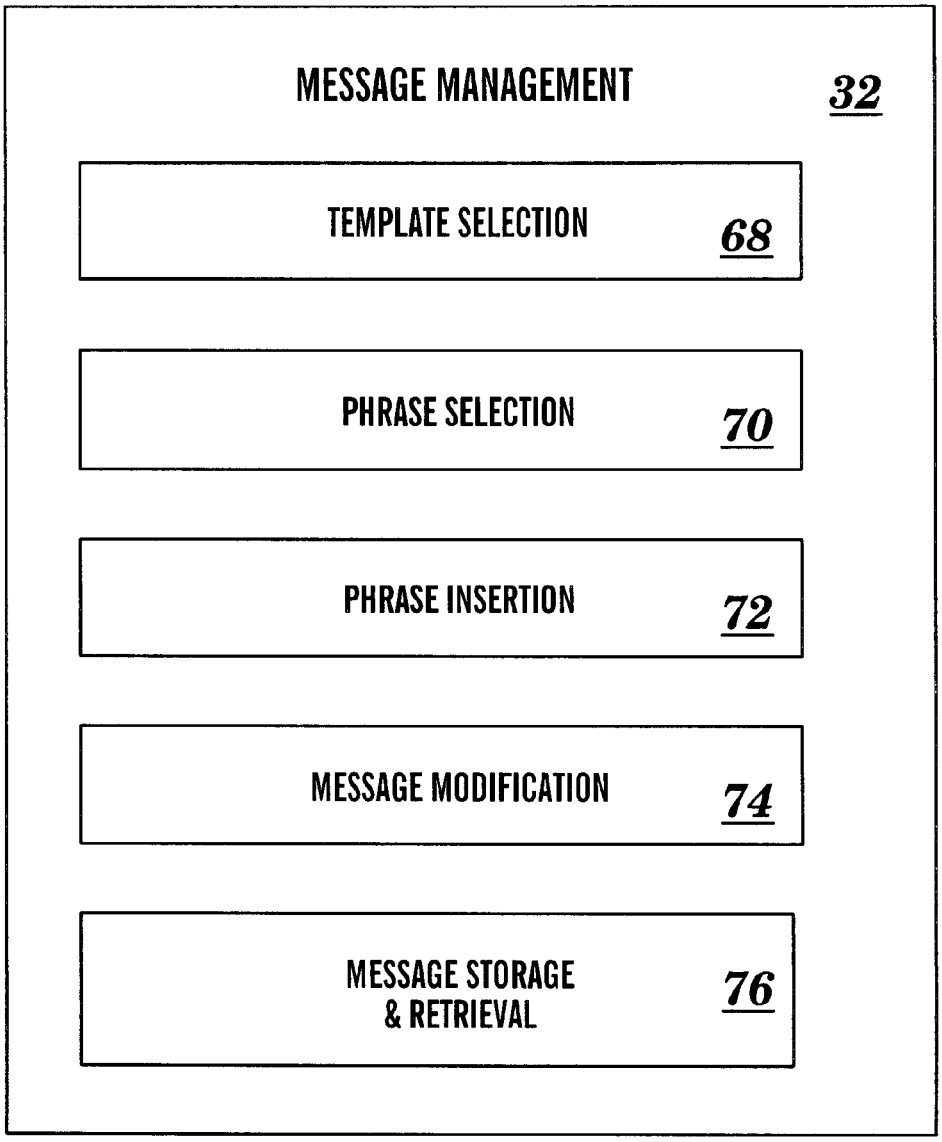
FIG. 4 depicts a message generation module of FIG. 1 in further detail.

FIG. 4 depicts message generation module 32, which combines templates 26 and phrases 22 to create messages 34. To generate messages, message generation module 32 includes a template selection system 68, a phrase selection system 70, and a phrase insertion system 72 for inserting the selected phrase into the selected template. Thus for example, assume that the above template and phrase were selected. Namely:

OUT_UNTIL="I will be out of the office until % day."; and $date1="Oct. 10, 2001"

Phrase insertion system 72 would then generate a new message, e.g., "Message1" by inserting the phrase into the massage. This could be accomplished by the following assignment:

Message1=OUT_UNTIL(% day=$date1).

The resulting message Message1 would thus be:

"I will be out of the office until October 10, 2001."

Resulting messages could be either be generated ahead of time and statically stored, or generated dynamically, when they are played. Message generation module 32 may also comprise a message modification system 74 for modifying messages after they are created, and a message storage and retrieval system 76 for storing and retrieving created messages.

In addition, basic default messages could be provided by message generation module 32. Thus, a user could, for example, simply record just their name and company name, which would be used with the default message.

Referring now to FIG. 5, a message management interface 80 is depicted for creating a new greeting. Interface 80 includes a first window for creating a greeting name 82, a button for saving the new greeting 84, and a schedule button 86 that will access the scheduling interface for scheduling this or other greetings. Additional features, although not shown, may include the ability to "select," "copy," "save-as," and/or "rename" greetings.

A second window 88 is provided for selecting a template. Templates may be selected, for example, by typing in the template name 90, or by selecting the template from a template display window 92. Template display window 92 displays one or more existing templates that can be used to create a desired greeting. In the example shown, three templates are depicted, one for a vacation greeting "VAC1," one for a meeting greeting "MEET1," and one for a backup greeting "BKUP1." The vacation greeting includes the template string, "I will be on vacation from" % DAY1 "until" % DAY2. The meeting template includes the string, "I will be in a meeting today from" % TIME1 "to" % TIME2. The backup template includes the string, "I am unavailable to take this call, please contact" % BACKUP "at" % ALT_NUM. As described above, each template includes text and variables. Any number of different templates may be included for selection. In addition, a user can create a new template 94 or modify an existing template 96. Furthermore, voice selection 100 allows the user to select the voice type for the greeting being created. For instance, the user may select a male voice 102, a female voice 104, or the user may wish to record their own voice 106. Although not shown, the ability to "copy," "save-as," and/or "rename" templates, may be readily included.

Once a template is selected (e.g., VAC1), all variables existing within the template must be assigned a selected phrase. This process is accomplished by phrase selection window 108. Phrase selection window 108 includes a list of the required variables 110 needed to be defined for the selected template. In the example shown, % DAY1 and % DAY2 need to be defined in order to complete the VAC1 template to create greeting VACATION_1. The first step is to select one of the required variables in the required variables window 110. Once a variable is selected, the user can assign it a phrase by inputting phrase data 114, by either recording their own voice 116, inputting text 118, or selecting an existing phrase 120. In the case where the user wants to record their own voice 116, this can be done either through the telephone 16 and phone interface 12, or through a microphone attached to terminal 18 (see FIG. 1). If the user decides to input text 118, they can type the text into a dialogue box 122 using a keyboard. Once the text is inputted, it can be converted to a voice file using speech synthesis module 48 or speech table 50. Alternatively, the user can select an existing phrase 120 shown in data window 124. For example, for the first variable % DAY1, the user could select "Oct. 1, 2001" from the data window 124. A name for the phrase can then be established by typing in a phrase name in the phrase name dialog 112.

The user then must repeat the variable defining process for each variable required in a given template. Once all of the variables have been defined, the greeting can be saved 84 and later scheduled for use as a greeting by the user's voice mailbox.

Referring now to FIG. 6, an exemplary scheduling interface 38 is shown. Scheduling interface 38 depicts each of the days of the month in a calendar format. Using standard Windows™ techniques (e.g., drop down menus, dialog boxes, etc.), the user can assign one or more different messages to different days and/or times of the month. For example, in the calendar shown, the user has assigned a default message 132 to November 1 through November 3, November 23 through November 24, November 27 through November 29, and after 3:00 p.m. on November 30. Also assigned is a weekend message 134 which has been assigned to November 4, 5, 25 and 26. A vacation message 136 has been assigned to the days from November 6 through November 19. Finally, on November 30, it can be seen that the user has assigned three different messages that include a cell phone message 134 from 8:00 a.m. until 12:00 p.m., a meeting message from 12:00 p.m. until 3:00 p.m., and a default message 132 from 3:00 p.m. on.

Accordingly, as can be seen, a user is able to schedule in advance all types of greetings, thereby alleviating the need to constantly change the greetings to accurately reflect the various scenarios facing the user. While the interface 38 of FIG. 6 depicts a calendar interface, it is understood that any type of scheduling interface could be utilized to schedule messages and greetings. In addition, although not shown, scheduling interface 38 could include default settings, that would automatically program weekend messages, after hour messages, default messages, etc.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

I claim:

1. A system for managing voice messages, comprising:

a phrase management module for managing phrases, wherein each phrase includes a specified time parameter;

a template management module for managing message templates, wherein each message template includes a variable that represents an undefined time parameter;

a voice management module for managing different voice types;

a message generation module for creating a message by inserting at least one phrase into a selected message template, such that the message is customized with the specified time parameter of the at least one inserted phrase, and such that the message is customized with a selected voice type; and a scheduling system for scheduling the message.

2. The system of claim 1, wherein the phrase management module comprises:

a phrase creation system for creating a new phrase;

a phrase input system for inputting phrase data; and a phrase storage system for storing the phrase data along with a phrase identifier.

3. The system of claim 2, wherein the phrase input system includes an audio input system.

4. The system of claim 2, wherein the phrase input system includes:

a text input system; and a speech synthesizer for converting text input to an audio file.

5. The system of claim 2, wherein the phrase storage system stores the phrase data in a digital format.

6. The system of claim 1, wherein the template management module includes:

a template creation system;

a template modification system; and a template storage and retrieval system.

7. The system of claim 1, wherein the message generation module includes:

a template selection system;

a phrase selection system; and a phrase insertion system.

8. The system of claim 1, wherein the scheduling system includes a calendar interface for scheduling messages.

9. The system of claim 1, wherein the message management module comprises a graphical user interface.

10. The system of claim 1, further comprising a telephonic interface for accessing the phrase management module, the template management module, the message generation module and the scheduling system.

11. A program product stored on a recordable media for managing voice messages via a graphical user interface (GUI), which when executed, comprises:

a first window for allowing a voice mail-box user to select a message template from a plurality of message templates within the GUI, wherein each message template can be displayed as a string of words representing a greeting in a voice mail system, wherein the string of words includes at least one undefined detail that is displayed as a variable;

a second window within the GUI for allowing the voice mail-box user to select a phrase, wherein the phrase defines the at least one undefined detail in the selected message template; and a system for creating a message by assigning the phrase to the variable and inserting the phrase into the selected message template.

12. The program product of claim 11, further comprising a system for selecting a voice to be used for broadcasting the message.

13. The program product of claim 11, including a system for scheduling the message which comprises a calendar interface.

14. The program product of claim 11, wherein the second window includes:

a system for selecting the phrase from a set of prerecorded phrases;

a system for inputting text to create the phrase; and a system for selecting the phrase from a textual list of stored phrases.

15. The program product of claim 14, wherein the system for creating the message assigns the identifier to the variable within the message template.

16. A method for managing voice messages, comprising the steps of:

selecting a message template, wherein the message template includes a variable that represents an undefined time parameter;

selecting a voice type;

selecting a phrase, wherein the phrase comprises a defined time parameter; and combining the phrase with the message template to form a message in the selected voice type.

17. The method of claim 16, wherein the phrase is selected from a group of at least one pre-recorded phrases stored as an audio signal.

18. The method of claim 16, wherein the phrase is selected from a group of at least one pre-recorded phrases stored as an inputted text string.

19. The method of claim 16, wherein the message template is selected from a group of at least one pre-recorded templates stored as an inputted text string.

20. The method of claim 16, wherein the message template is selected from a group of at least one pre-recorded templates stored as an audio signal.

21. The method of claim 16, wherein the time parameter comprises a date.

* * * * *